United States Patent [19]

Stuckey et al.

[11] 4,173,006

[45] Oct. 30, 1979

[54] VARIABLE RESISTANCE CONTROL

[75] Inventors: Ronald L. Stuckey, Monroe; Jack L. Miller, Decatur, both of Ind.

[73] Assignee: CTS Corporation, Elkhart, Ind.

[21] Appl. No.: 885,686

[22] Filed: Mar. 13, 1978

[51] Int. Cl.[2] ..... H01C 1/02; H01C 10/00

[52] U.S. Cl. ..... 338/184; 338/334

[58] Field of Search ..... 338/184, 199, 164, 174, 338/160, 162, 166, 172, 188, 190, 334; 361/395, 397, 399, 400

[56] References Cited

U.S. PATENT DOCUMENTS

| | | | |
|---|---|---|---|
| 3,018,459 | 1/1962 | Hardison | 338/180 |
| 3,201,737 | 8/1965 | Mathison | 338/174 |
| 3,329,919 | 7/1967 | Lau | 338/68 |
| 3,739,468 | 6/1973 | Hill, Jr. | 338/184 X |

*Primary Examiner*—C. L. Albritton

*Attorney, Agent, or Firm*—John J. Gaydos

[57] ABSTRACT

A variable resistance control comprising a variable resistance control portion and a stabilizer assembly portion. The variable resistance control portion is provided with a housing, a resistance element and a contactor supported within the housing with the contactor wipably engaging the resistance element, and an adjustment member operatively connected to the contactor and exposed on the exterior of the housing. The stabilizer assembly portion comprises a stabilizer having weight greater than the weight of the variable resistance portion and having a threaded bushing. An aperture extends through the stabilizer and the bushing and an extension shaft is rotatably received in the aperture with one end extending outwardly from the aperture cooperatively engaging the adjustable member. A U-shaped plate having a bight portion and a pair of arms secures the stabilizer to the housing. The bight portion is provided with an aperture within which the threaded bushing is received and the arms extend and crimpingly engage the housing. The stabilizer and the housing are each provided with coplanar engagement surfaces.

5 Claims, 4 Drawing Figures

VARIABLE RESISTANCE CONTROL

The present invention relates to a variable resistance control and, more particularly to a stabilizer for such a control.

Variable resistance controls and, more particularly, miniature single-turn trimmer controls, are often of lightweight construction and are adapted for mounting on a printed circuit board or the like. It is desirable that these trimmers be usable in an interchangeable manner to reduce the number of components necessary for a given application where a number of controls having different mechanical configurations must be used. Such miniature controls often are mounted only by the leads to a printed circuit board and are adjustable through an adjustment means accessible through the housing. To facilitate the adapting of such miniature controls to more universal applications such as mounting to a panel, the present invention is directed.

Miniature trimmers are lightweight and normally have no securement means other than the leads for connection to a printed circuit board. The control is positioned on the printed circuit board with the leads from the control extending through appropriate holes in the board and extending past the opposite side of the printed circuit board with the opposite side often having a copper film adheringly secured to the board. It is a common practice to solder a component such as a trimmer control to the printed circuit board by passing the board through a wave solder machine. In a wave solder machine, molten solder is pumped in gusher fashion upwardly, and with the printed circuit board secured to a moving carrier, the bottom of the board is brought into contact with the gusher of molten solder and immersed in the solder to a predetermined depth. The solder, comprising in large part, the heavy element lead alloyed with tin, exerts appreciable force against the bottom of the printed circuit board due to the weight of the solder and the velocity thereof. Consequently, it is common for the components mounted on the printed circuit board to be lifted to some degree by the force of the solder upwardly against the leads.

A miniature trimmer control, being of light weight, is susceptible to such movement when being soldered. For a miniature control having a shaft and a mounting means, such as the control of the present invention, it is important that the orientation of the control with respect to the printed circuit board be maintained in accurate alignment. Otherwise, when the mounting means is utilized to mount the control to a panel or the like, the printed circuit board will not have the correct orientation. Accordingly, it is desirable that means be provided to prevent the lifting up of the miniature control from the board when being soldered. One way of accomplishing such lift prevention is to add a weighted stabilizer to the control to counteract the upward force of the solder. It is also desirable that the means provided for preventing lift up of the control when the printed circuit board is soldered also be instrumental in orienting and positioning the control on the printed circuit board.

The prior art shows examples where a mounting means and a shaft extension have been added to a variable resistance control. Some of such examples are shown in U.S. Pat. Nos. 2,984,804; 3,018,459; 3,133,260; 3,329,919; and 3,597,718. However, none of these examples shows adding a weighted stabilizer to the control to maintain the positioned orientation of the control on a printed circuit board. In the U.S. Pat. No. 3,018,459, the flange is flared radially to form a thin walled support for the stud and any thickness of the flange is for support strength purposes.

Additionally, none of the prior art shows an electric control wherein a stabilizer and a portion of the control are each provided with engagement surfaces which, in cooperation with the weight of the stabilizer, maintain the positioned orientation of the control.

Accordingly, a primary objective of the present invention is to provide an electric control wherein the three dimensional orientation of an extension shaft is accurately determined.

Another object of the present invention is to provide an electric control having a stabilizer. A further object of the present invention is to provide an electric control having a stabilizer wherein the stabilizer is provided with an engagement surface which is coplanar with a second engagement surface of the control.

Further objects and advantages of the present invention will become apparent as the following description proceeds and the features of novelty characterizing the invention will be pointed out with particularity in the claims annexed to and forming a part of this specification.

Briefly, the present invention relates to a stabilizer for a miniature variable resistance control. The weighted stabilizer abuttingly engages a portion of the housing and is provided with a threaded bushing extending away from the housing. The stabilizer and the threaded bushing are provided with an aperture in which an extension shaft is rotatably received. One end of the shaft is operatively connected with an adjustable member of the control and the other end of the shaft extends outwardly from the threaded bushing. A U-shaped securement plate having a bight portion and a pair of arms secures the stabilizer and the extension shaft to the housing. The bight portion abuttingly engages the stabilizer proximal the threaded bushing and the arms extend past the stabilizer and securingly engage the housing of the control.

For a better understanding of the present invention, reference may be had to the accompanying drawings wherein the same reference numerals have been applied to like parts and wherein.

Figure 1:
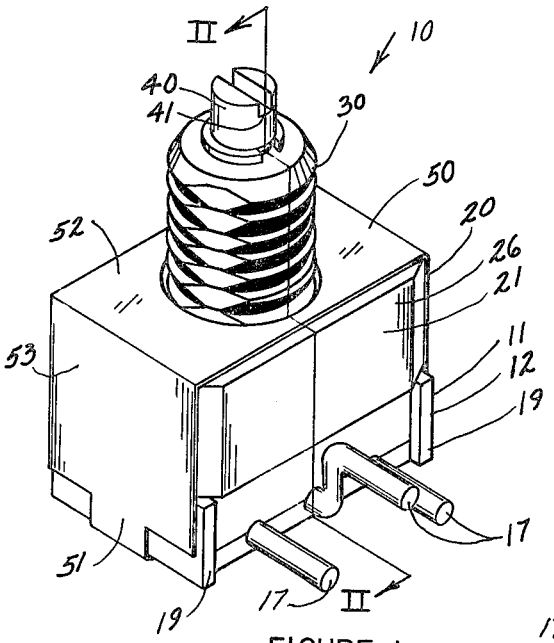
FIG. 1 is an isometric view of the exemplary embodiment of the present invention.

Referring now to the drawings, FIG. 1 shows a variable resistance control generally designated 10, comprising a miniature variable resistance trimmer control 11 and a stabilizer assembly 20. The control 11 (see FIG. 2) comprises a housing 12, a rotatably supported actuator means or driver 13, a movable contactor 14 constrained to rotate with the driver 13, and a base 15 supporting a resistance path **16*a* and collector 16*b* wipably engaged by the contactor 14. A plurality of leads 17 electrically connect to the resistance path 16*a* and the collector 16*b* and extend outwardly of the housing 12** for connection to an external circuit. The miniature variable resistance trimmer control of this embodiment of the present invention is more completely described in U.S. Pat. No. 3,518,604 which is hereby expressly incorporated by reference herein and is of a common assignee.

The stabilizer assembly comprises a stabilizer 21, a threaded bushing 30 integral with the stabilizer, an extension shaft 40 rotatably supported by the stabilizer 21 and the bushing 30, and a plate 50 comprising tabs 51 securing the stabilizer 21 against movement relative to the control 11.

More specifically, the stabilizer 21 is generally rectangular in shape and, in the present embodiment, is made of machinable brass which is suitably plated. A major side 22 of the stabilizer 21 abuttingly engages and substantially covers a front side 18 of the housing 12. The stabilizer 21 has a weight greater than that of the miniature control 11 and maintains the positioned orientation of the control 10 and, in particular, the positioned orientation of the extension shaft 40 relative to a printed circuit board when the control 10 is wave soldered thereto.

In accord with the present invention, the control 11 and the shaft 40 have approximately the same weight, namely, about one gram. The stabilizer 21 of this embodiment weighs approximately five hundred (500%) percent more than the weight of the control 11 so that the combined weight of the stabilizer 21 and the shaft 40 is approximately six hundred (600%) percent greater than the weight of the control 11. However, for effective stabilization, it is desirable that the added weight be at least two hundred (200%) percent greater than that of the control 11. See table 1.

TABLE 1

| Added weight as a Percentage of Control Weight | | |
|---|---|---|
| | Necessary Weight | Present Embodiment |
| Shaft | 100% | 100% |
| Stabilizer | 100% | 500% |
| Total | 200% | 600% |

The ratios of shaft weight to stabilizer weight can be changed as long as the total added weight complies with the weight requirement shown in Table 1 and a substantial portion of the weight is disposed in the stabilizer.

Figure 4:
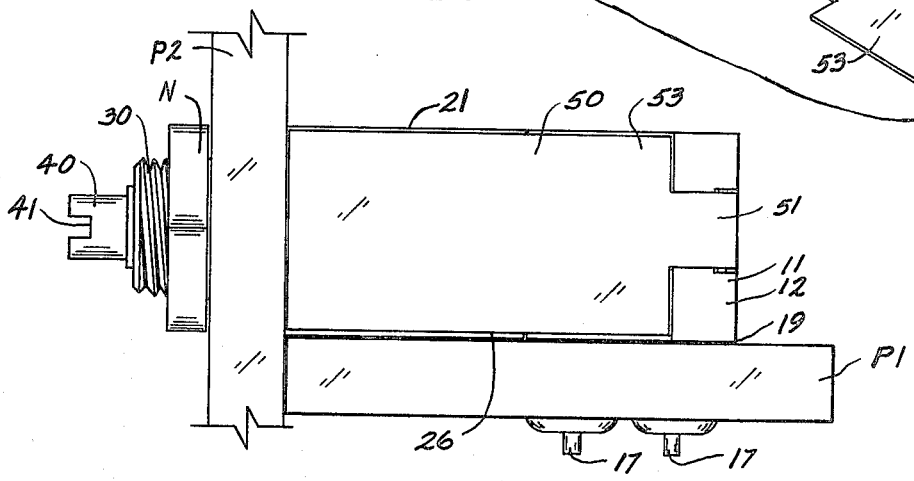
FIG. 4 is a side view of the control and stabilizer assembly of the present invention shown mounted to external planar members such as a printed circuit board and a panel.

The threaded bushing 30 extends outwardly from the other major side 23 of the stabilizer 21 distal of the control 11 and is threaded to accept an appropriately threaded nut N (see FIG. 4).

An aperture 24 extends through the stabilizer 21 normal to the major sides 22 and 23 and through the threaded bushing 30. The extension shaft 40 is receivably supported within the aperture 24 with an outer end extending outwardly past the threaded bushing 30 and provided with a screwdriver adjustment slot 41. The inner end of the extension shaft 40 is provided with an integral circular shoulder 42 extending radially outward. A tongue 43 extends toward and is in engagement with the driver 13 of the control 11 and is disposed at a diameter of the shoulder 42. A "C" washer 44 is secured to the shaft 40 at an undercut 45 to provide impact protection for the control 11 in the event that a sharp blow is delivered to the shaft 40.

Figure 2:
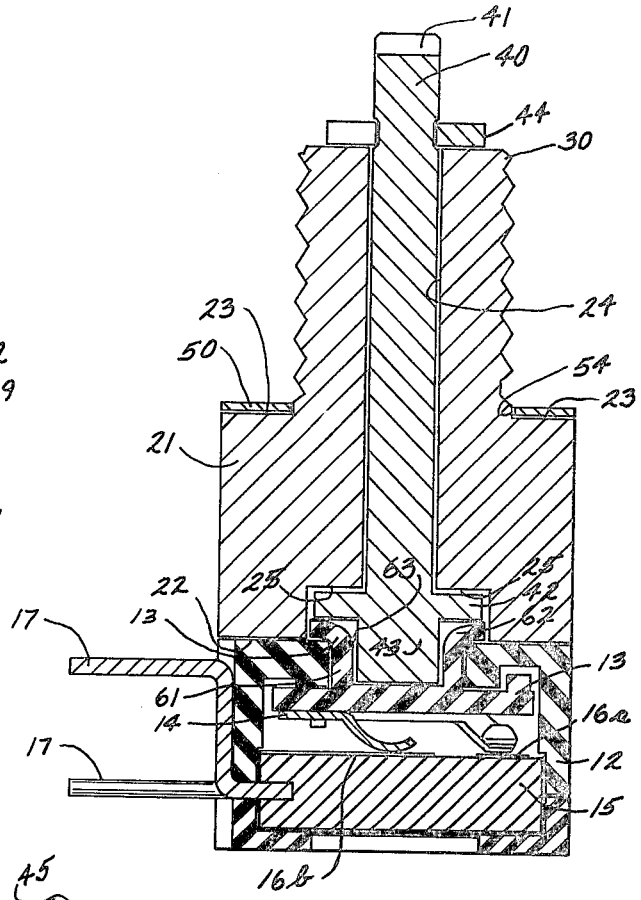
FIG. 2 is a sectional view taken approximately along line II—II of FIG. 1.
Figure 3:
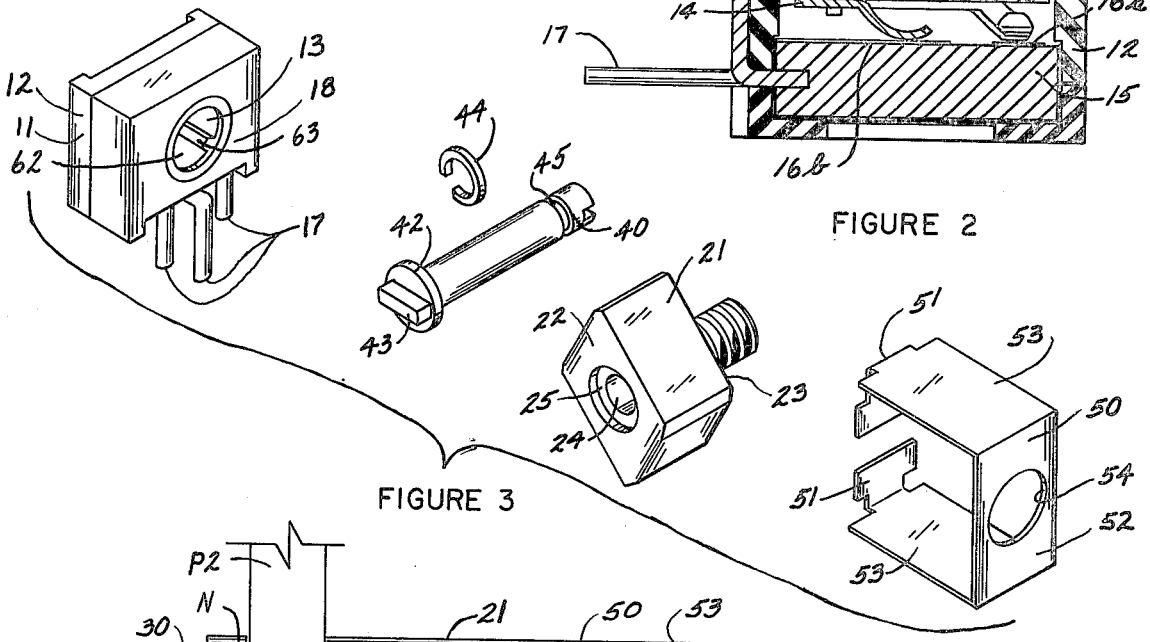
FIG. 3 is an exploded view of the variable resistance control and stabilizer assembly of FIG. 1.

Referring now to FIG. 2, the driver 13 comprises a barrel 61 terminating in a head 62 provided with a slot 63. The tongue 43 is received within the slot 63 constraining the driver 13 for rotation with the shaft 40. The shoulder 42 is nested within a bore 25 in the stabilizer 21 at the major side 22 thereby axially retaining the extension shaft 40 within the aperture 24.

A U-shaped plate 50 comprises a bight portion 52 and a pair of arms 53 extending normal to the bight portion 52 with each of the arms 53 provided with one of the securement tabs 51. The bight portion 52 is provided with an aperture 54 in which the threaded bushing 30 is received with the bight portion abuttingly engaging the major side 23. The tabs 51 extend past the end of the housing 12 distant from the stabilizer 21 and are bent toward each other crimpingly securing the plate 50 to the housing 12 and securing the stabilizer assembly 20 to the miniature control 11. The securement provided by the tabs 51 must be of sufficient strength to withstand the additional forces exerted upon the tabs 51 by the weight of a printed circuit board $P_1$ after the variable resistance control 10 is mounted to a panel $P_2$ by the threaded bushing 30 and a nut N as will be described hereinafter.

Referring now to FIG. 4, a lower side 26 of the stabilizer 21 is disposed substantially coplanar with lower support ridges 19 of the control 11. When the leads 17 of the miniature control 11 are soldered to a printed circuit board $P_1$, the top surface of the printed circuit board abuttingly engages the support ridges 19 and the lower side 26 thereby vertically orienting the extension shaft 40 parallel to the plane of the printed circuit board $P_1$.

The extension shaft 40 permits adjustment of the driver 13 after the variable resistance control 10 has been mounted to a panal $P_2$. As is often the case, the control 11 is mounted to a panel $P_2$ by the stabilizer assembly 20 after having been soldered to a printed circuit board $P_1$ by the leads 17 which extend through appropriate apertures in the printed circuit board. Any positional misplacement of the shaft and the threaded bushing when the control 10 is mounted on the printed circuit board $P_1$ will cause the printed circuit board to be misoriented when the stabilizer assembly 20 is secured to the panel $P_2$. Therefore, it is necessary to predetermine and maintain the orientation of the bushing 30 with respect to the printed circuit board.

The leads 17 positionally determine the location of the shaft 40 and the threaded bushing 30 in a plane parallel to the board $P_1$ along two orthogonal axes. The lower side 26 is coplanar with the support ridges 19 and the weight of the stabilizer 21 in cooperation with the side 26 and the support ridges 19 thereby determines and maintains the orientation of the extension shaft 40 and the threaded bushing in a vertical direction. As is often the case, components on a printed circuit board when soldered thereto by a wave soldering operation have a strong tendency to move upwardly from their original position. In the present embodiment, extra weight is added in the form of a stabilizer 21 and the shaft 40 to counteract and minimize such positional displacement and thereby maintain the positional orientation of the threaded bushing 30 along a third orthogonal axis.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

We claim:

1. An electrical control comprising an electrical device, actuator means for operating the electrical device, terminal means for connecting the electrical device to an external circuit, the actuator means being connected to a first electrical member movable with respect to a second electrical member of the device for changing the electrical output at the terminal means, a stabilizer secured to the device, means for securing the stabilizer to the electrical device, the stabilizer having a weight greater than the weight of the electrical device, and a mounting means for securing the electrical device to a first external member.

2. The control of claim 1, wherein the stabilizer is provided with a first engagement surface and the device is provided with a second engagement surface, the first and second engagement surfaces being outer surfaces of the control and coplanar.

3. The control of claim 2, wherein the terminal means comprise at least two leads extending from the device and constrainable to a second external member, and the first and second engagement surfaces are abuttably engageable with the second external member, the leads being adapted positionally to orient the control in two orthogonal axes, the first and second engagement surfaces being adapted positionally to orient the control in a third orthogonal axis.

4. A variable resistance control comprising a control portion having a housing, a resistance element and a contactor supported within the housing, the contactor wipably engaging the resistance element, one of the contactor and the resistance element being movable with respect to the other, a plurality of terminals extending from the housing for connection of the resistance element and the contactor to an external circuit, an adjustment means for moving one of the contactor and the resistance element relative to the other, the adjustment means operatively connected to one of the contactor and the resistance element and exposed on the exterior of the housing, and a stabilizer portion comprising a weighted stabilizer having one side abuttingly engaging the housing, the weight of the stabilizer being greater than the weight of the control portion, a mounting means extending from the stabilizer opposite the one side for securement to a first external member, the stabilizer and the mounting means having an aperture extending therethrough, a shaft rotatably supported in the aperture, the end of the shaft proximal the one side engaging the exposed adjustment means and constrained to rotate therewith, a U-shaped plate having a bight portion and a pair of arms, the bight portion abuttingly engaging the stabilizer opposite the side, the arms extending toward the housing past the stabilizer, and tabs disposed at the distal end of each of the arms crimpingly secured about the housing thereby securingly engaging the housing against the stabilizer.

5. The control of claim 4 wherein the stabilizer portion is provided with a first engagement surface and the control portion is provided with a second engagement surface, the first and second engagement surfaces being co-planar outer surfaces of the control and abuttingly engageable with a second external member.

* * * * *